US006880187B1

(12) United States Patent
Johnson

(10) Patent No.: US 6,880,187 B1
(45) Date of Patent: Apr. 19, 2005

(54) LIFTING APPARATUS

(76) Inventor: Robert E. Johnson, 2034 Pittway Dr., Nashville, TN (US) 37207

( * ) Notice: Subject to any disclaimer, the term of this patent is extended or adjusted under 35 U.S.C. 154(b) by 0 days.

(21) Appl. No.: 10/436,439

(22) Filed: May 13, 2003

Related U.S. Application Data

(60) Provisional application No. 60/379,387, filed on May 13, 2002.

(51) Int. Cl.[7] ..... A61G 7/00

(52) U.S. Cl. ..... 5/83.1; 5/81.1 R; 5/86.1

(58) Field of Search ..... 5/81.1 R, 83.1, 5/86.1, 89.1

(56) References Cited

U.S. PATENT DOCUMENTS 2,908,916 A * 10/1959 Fischer et al. ..... 5/86.1

* cited by examiner

*Primary Examiner*—Michael F. Trettel
*Assistant Examiner*—Fredrick Conley
(74) *Attorney, Agent, or Firm*—Banner & Witcoff, Ltd.

(57) ABSTRACT

A system and method for adjusting a person's upper torso in particular, the forearms to a generally parallel position to a floor surface in relation to a work product. A lifting apparatus includes a base support for moving the lifting apparatus horizontally on a floor surface. The base support may include a plurality of wheels being lockable. A platform having a multilayer construction for supporting at least a user thereon. The multilayer construction having a non-slip layer outer layer, a compressible inner layer, and a base layer. A vertical lifting system coupled to a platform and coupled to a base support. The vertical lifting system is configured to vertically move the platform through a plurality of heights above a floor surface. The vertical lifting system may have a pair of laterally mounted hollow stanchions in which each stanchion includes a axially rotatable threaded rod for matingly receiving a gear which is mounted to a drive shaft that provides rotary movement to the gear. The vertical lifting system may include a motor coupled to the drive shaft and configured to provide rotary movement to the drive shaft. The vertical lifting system may include a controller unit coupled to the motor configured to control the operation of the motor. A non-contact foot sensing device mounted to the base support and operatively coupled to a controller unit. The sensing device is configured to detect the presence a foot of a human body underneath the platform and prevent downward movement of the platform while the foot being detected.

5 Claims, 7 Drawing Sheets

LIFTING APPARATUS

CROSS REFERENCE TO RELATED APPLICATIONS

This application is a non-provisional patent application of U.S. Patent Application No. 60/379,387, filed May 13, 2002, which is hereby expressly incorporated by reference.

FIELD OF THE INVENTION

The present invention generally relates a lifting apparatus for personnel and material, in particular to a power-assisted ergonomic lifting platform in workplace conditions.

BACKGROUND OF THE INVENTION

According to occupational therapy doctors, a person working with their forearms on a workstation may have significant cumulative trauma or other injury, such as musculoskeletal fatigue, or inhibited circulation. When a person's body is unsupported, the muscle around the joints may tire quickly due to constant strain and stress. The skeletal structure of the limbs has a difficult time maintaining an awkward posture at an improperly positioned workstation. The awkward posture can contribute to undesirable musculoskeletal discomfort and fatigue, for example tendonitis or arthritis. Thus, there is a need for an effective solution to overcome this problem.

SUMMARY OF THE INVENTION

In view of the foregoing, the present invention is generally directed to a system and method for easily adjusting a person's upper torso in particular, the forearms to a generally parallel position to a floor surface in relation to a work product. In the particular, an aspect of the present invention provides a lifting apparatus.

In one aspect, a lifting apparatus includes a base support for moving the lifting apparatus horizontally on a floor surface. The base support may include a plurality of wheels being lockable.

In another aspect, a lifting apparatus includes a platform having a multilayer construction for supporting at least a user thereon. The multilayer construction may include a non-slip layer outer layer, a compressible inner layer, and a base layer.

In another aspect, a lifting apparatus includes a vertical lifting system coupled to a platform and coupled to a base support. The vertical lifting system is configured to vertically move the platform through a plurality of heights above a floor surface. The vertical lifting system may have a pair of laterally mounted hollow stanchions in which each stanchion includes an axially rotatable threaded rod for matingly receiving a gear which is mounted to a drive shaft that provides rotary movement to the gear. The vertical lifting system may include a motor coupled to the drive shaft and configured to provide rotary movement to the drive shaft. The vertical lifting system may include a controller unit coupled to the motor configured to control the operation of the motor.

In yet another aspect, a lifting apparatus includes a base support, a platform, a vertical lifting system, and a non-contact foot sensing device mounted to the base support and operatively coupled to a controller unit. The sensing device is configured to detect the presence a foot of a human body underneath the platform and prevent downward movement of the platform while the foot being detected.

According to the aspects of the present invention, a lifting device properly adjusts an operator to a desirable work height alignment, yields injury reduction, and faster, more precise and comfortable operator performance. With the use of the present invention, a person has no straining of the back or upper torso region because reaching or stooping are minimized, if not totally eliminated. This increases productivity of the operator. Furthermore, their work product with the forearms parallel to the floor provides an optimal viewing position to see the work product location. Advantageously, throughout the workday, the person is more comfortable by not having to bend and overreach while working. The features of the invention, including speed, precision and comfort lead to greater productivity and less accident proneness in the workplace.

The above and other aspects, features and advantages of the present invention will be readily apparent and fully understood from the following detailed description of preferred embodiments, taken in connection with the appended drawings.

BRIEF DESCRIPTION OF THE DRAWINGS

The foregoing overview of the invention, as well as the following detailed description of the preferred embodiments, is better understood when read in conjunction with the accompanying drawings, which are included by way of example and not by way of limitation with regard to the inventions wherein.

DESCRIPTION OF THE PREFERRED EMBODIMENTS

FIGS. 1–9 illustrate various aspects and features of lifting devices 100 and 200 according to the teaching of the present invention. In one aspect, the lifting devices 100 (see FIG. 1) and 200 (see FIG. 5) may be provided to raise a person that is in an erect or seated position to a desired height above a floor surface. In particular, lifting devices 100 and 200 can easily position a person's forearms in a working position parallel to the floor surface in relation to a product on a table or a working surface. Depending on the job requirement and physical body heights of the operators, the lifting devices 100 and 200 can accommodate multiple workers on the devices. Nevertheless, lifting devices 100 and 200 can be used to transport material and/or personnel vertically to a desired working height. Unless otherwise noted, the lifting devices may be constructed from conventional materials.

Figure 1:
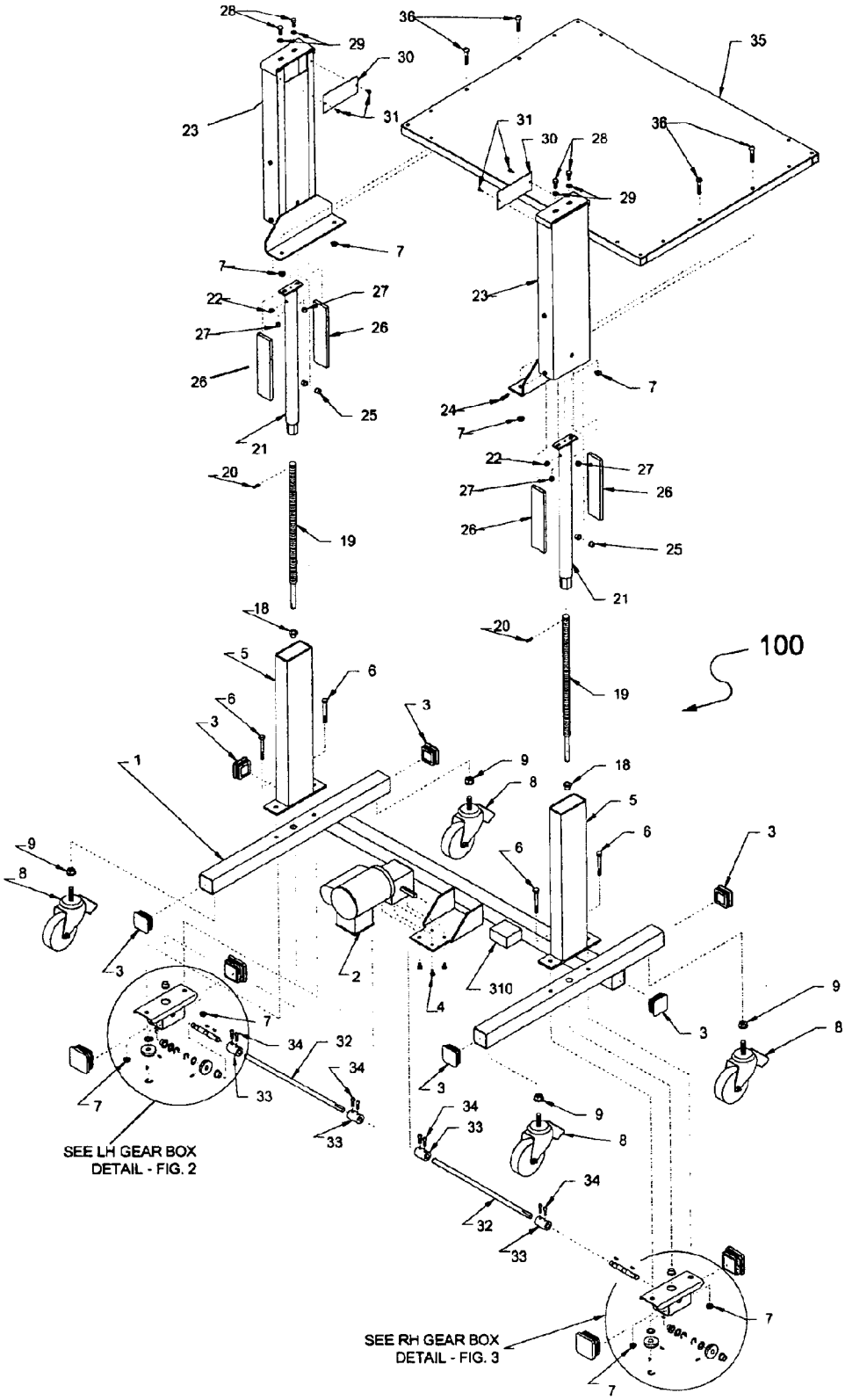
FIG. 1 is an exploded assembly view of one embodiment of a lifting device according to the teachings of the present invention.
Figure 2:
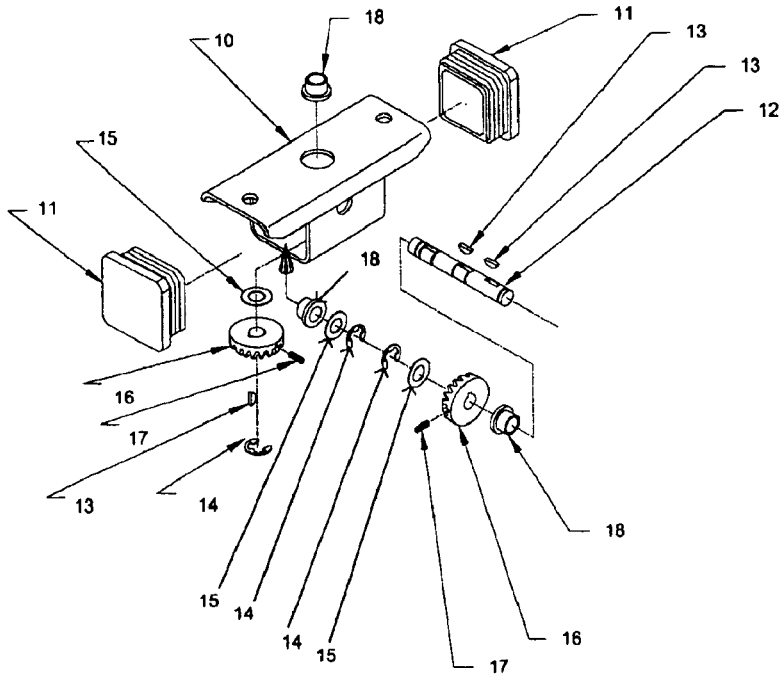
FIGS. 2–4 are views of components of the lifting device of FIG. 1 illustrating various components thereof.
Figure 3:
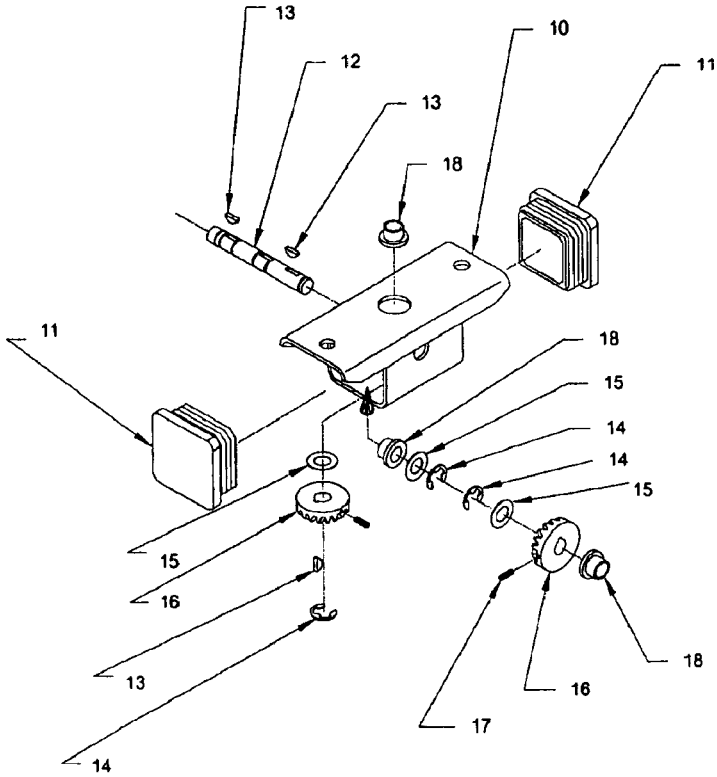
Figure 4:
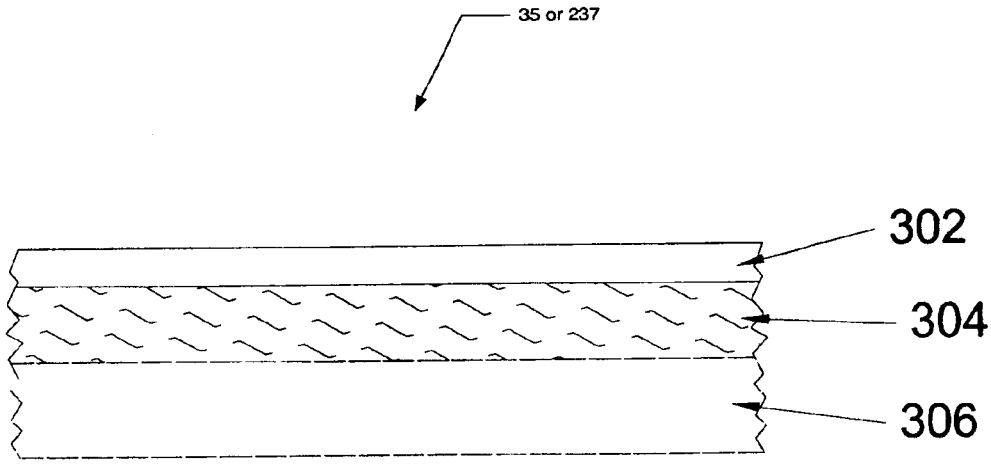
Figure 5:
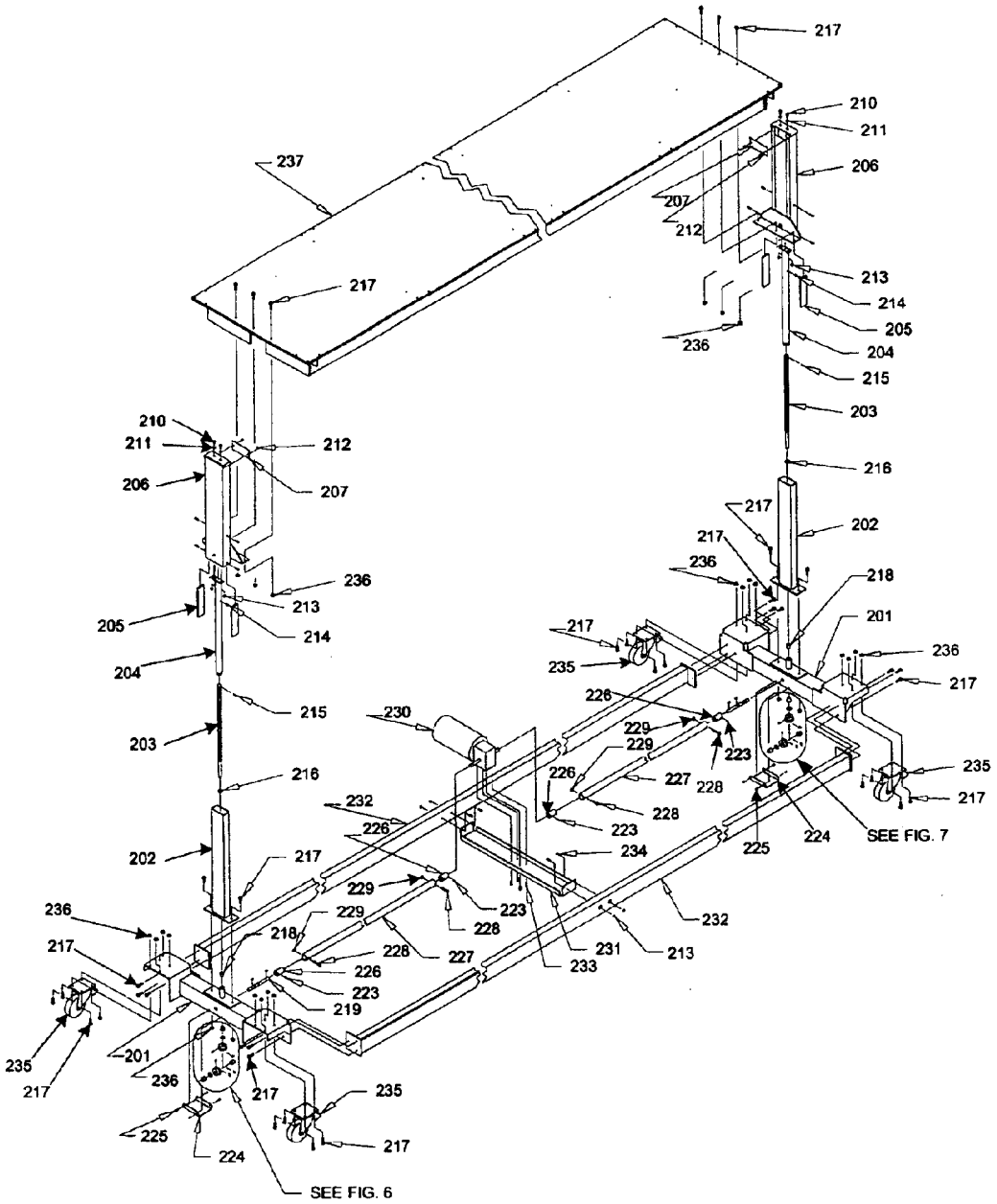
FIG. 5 is an exploded assembly view of another embodiment of a lifting device according to the teachings of the present invention.
Figure 6:
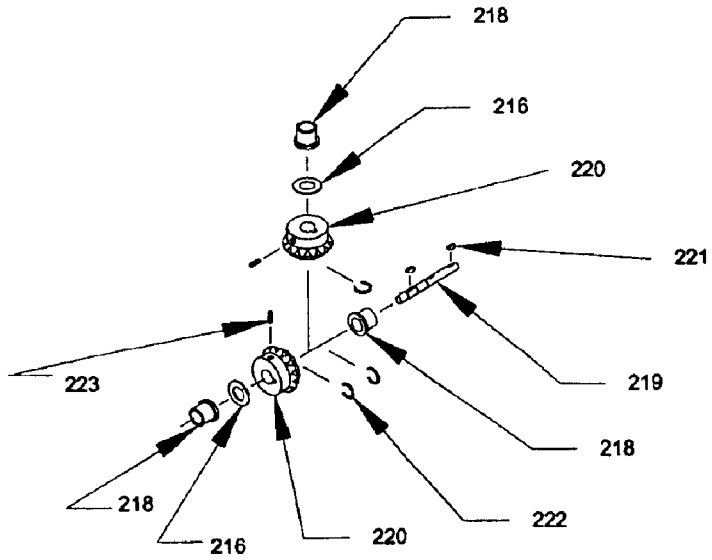
FIGS. 6–8 are views of components of the lifting device of FIG. 5 illustrating various components thereof.
Figure 7:
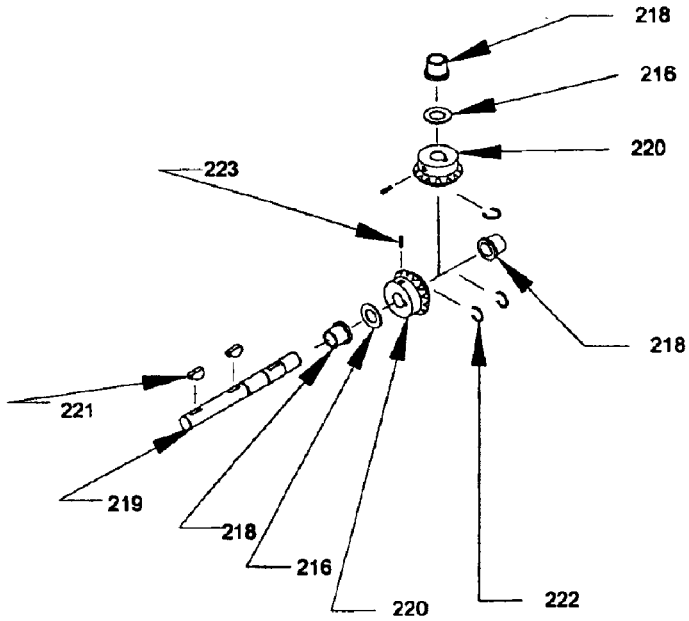
Figure 8:
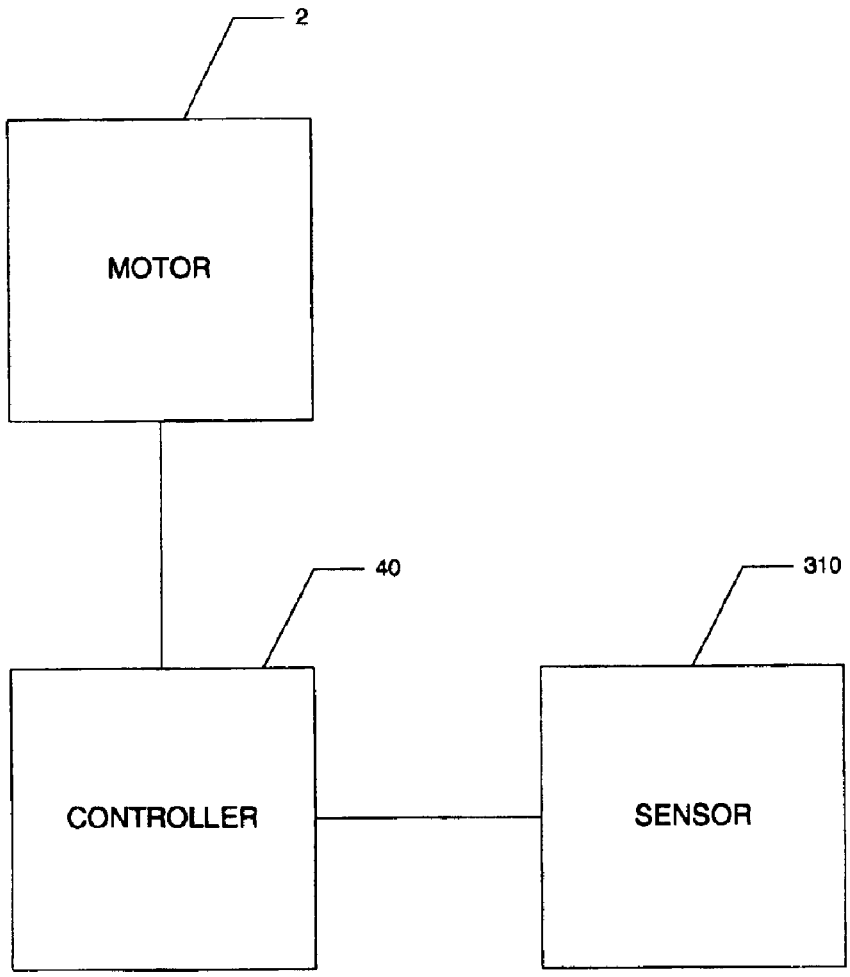
Figure 9:
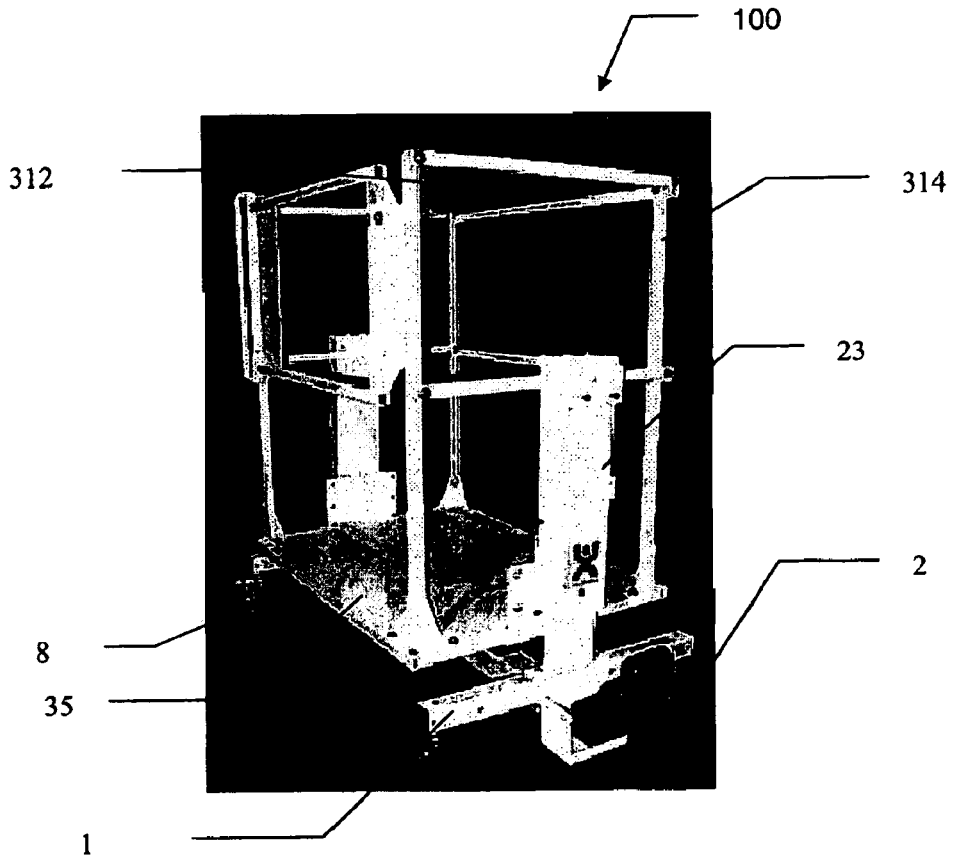
FIG. 9 is a perspective view of a level lift of the present invention including certain aspects of FIGS. 1–4 and 8.

In a preferred construction referring to FIGS. 1 and 5, lifting devices 100 and 200 have a platform 35, 237 that is fixely mounted to a vertical lifting system. The vertical lifting system is mounted to a base support 1. The platform 35, 237 is a generally horizontal surface that may be constructed of a variety of materials. In one construction shown in FIG. 4, the platform may be a therapy platform for maximum therapeutic comfort of the operator or operators. In such a case, the platform may be a multi-layer construction to include a non-slip work surface layer 302, a resilient compressible core 304, and a structural base 306, such as wooden board or a metal plate. The construction of the platform can reduce the stress of standing by approximately 50%. To accommodate the numerous uses of the lifting device 100 and 200, the platform may be provided in a square or rectangle in different lengths and widths. The lengths may range from 3 feet to 20 feet or more to accommodate assembly line operations, if desired. The widths may be adjusted to 3 feet or more.

It should be noted that lifting device 200 has the same basic construction of lifting device 100, therefore for ease of explanation of the vertical lifting system, the description will focus on the construction of lifting device 100. Referring to FIG. 1, the vertical lifting system is screw-driven which includes two laterally mounted threaded rods 19, 203 (See FIGS. 1 and 5) that are matingly received by gear teeth 16, 220 (see FIGS. 2 and 3) with two drive shafts 32 (see FIG. 1) and 227 (see FIG. 5) respectively connected to an electric motor 2, 230 (see FIGS. 1 and 5). In FIG. 1, coupling 33, 226 is connected to the drive shaft 32, 227 and to the rear box drive shaft 12, 219. A set screw 34 may be used to attach the coupling 33 to the motor 2 and to the drive shaft 32. Likewise, as shown in FIG. 5, a set screw 223 may be used to attach the coupling 226 to the motor 230. Bolts 228 and nut 229 can attach the coupling 226 to the drive shaft 227. In an alternative construction, the drive shafts may include integral flexible joints to accommodate various constructions. In yet an alternative construction, the drive shafts may be constructed from an elongated inner-coiled spring located inside of an elongated flexible outer sheath. The outer sheath may be preferably also a coiled spring. Alternatively, the outer sheath can be a flexible tubular conduit in lieu of a coiled spring. The outer sheath may be connected at its ends to a portion of the motor and other part of the lifting device, such as a gearbox housing. The inner-coiled spring provides rotation from the motor to the gearing to drive the threaded rods. This alternative construction is disclosed in U.S. patent application Ser. No. 09/759,203, filed Jan. 16, 2001 by Robert E. Johnson, now U.S. Pat. No. 6,510,759 which is expressly incorporated by reference. Nevertheless, in the construction of the drive shafts, the rotating component is shielded by a stationary guard to provide protection and shielding.

In these constructions, lifting device 100 includes a reliable transfer drive without a chain or sprocket system which are known to have high failure rates. The upper ends of the treaded rods 19, 203 are matingly received into a threaded precision nut fixely mounted at the lower end of a hollow-drive tube 21, 204 (see FIGS. 1 and 5). The upper end of the drive tube is mounted to a movable channel member 23, 206 (see FIGS. 1 and 5) which moves up and down as the drive tube moves. The upper end of the drives tubes 21, 204 may be connected to the channel members 23, 206 by bolts 28, 210 and washers 29, 211. In use, as the threaded rods 19, 203 turn, the precision nut mounted to the drive tube, moves along the rods so that the drive tube moves upwardly and downwardly. Accordingly, this operation moves the platform 35, 237 (see FIGS. 1 and 5) upward and downward. A pair of laterally mounted hollow stanchions 5, 202 (see FIGS. 1 and 5) extend upward from the base support 1. The stanchions 5 may be mounted to the base support 1 via bolts 6 and corresponding nuts 7 and to the gearbox 10 which is underneath the base support 1. The stanchions preferably have a square cross section though other shapes could be used. The moveable channel members 23, 206 receive the hollow stanchions 5, 202 by being slightly larger. The threaded rods are enclosed within the stanchions 5, 202 to provide protection and covering. The platforms 35 and 237 are connected to the channel members 23, 206 by screws 36, bolts 217 and nuts 7, 236. The channel member 23, 206 have an access cover 30, 207 which is connected thereto by screws 31, 212. The drives tubes 21, 204 are connected to the channel members 23, 206 by bolts 28, 210, washers 29, 211 and nuts 27, 213. Guide strips 26, 205 may be used inside of the channel member 23, 206. Threaded rods 19, 203 may have a set screw 20, 215 and a lower bushing 18, 216. A grease fitting 22 is provided on the drive tube 21.

In one construction, the motor 2 may be generally mounted to and centered on the base support 1. As shown in FIG. 5, motor 230 is mounted to a bracket 231 with screws 233. The bracket 231 is mounted to cross tube 232 with screws 234 received with nuts 213. The cross tube 232 are mounted to the gearbox 201 on lateral sides. In the other constructions, the motor may be mounted on other parts of the lifting device, such as on the lateral sides thereof or other locations to move the platform lower to the floor surface. A first drive shaft 32 is connected to one side of the motor 2 to a first gearbox (RH gear box shown in FIGS. 1 and 3). The second drive shaft 32 is connected to the other side of the motor 2 to a second gearbox on the opposing side thereof (LH gear box shown in FIGS. 1 and 2). The gearbox 10, 201 details are clearly shown in FIGS. 2, 3, and 6, 7 wherein two miter gears 16, 229 are (upper and lower) meshed together such that a lower end of the thread rods attached to the upper gear. The gears 16, 229 may include washer 15, 216, a set screw 17 and a retaining ring 14, 220. The gearbox 10, 201 may include a coupling 12, 219 with a kev 13, 221. A plastic plug cap 11 may be included on the gearbox 10 and an access cover 224 with screws 225 for gearbox 201. Stanchions 202 are mounted to gearbox 201 by bolts 217. The motor is reversible so that the first drive shaft and second drive shafts may turn simultaneously either clockwise or counter-clockwise to drive the gears which turn the precision threaded shafts into the fixed precision nut on both sides of the platform. If power is stopped to the motor, the two vertical threaded rods remain in a static position in contact with the precision nut and gearing so that the lifting device 100 is prevented from traveling up and down. Advantageously, this feature assures operator safety in the event the motor fails when the platform is raised because the platform is generally locked from moving downward according to one construction.

The motor 2 is controlled with a control switch 312 or a remote handheld control. The control switch may be located for ready convenient access by the operator. For example, the control switch 312 may be mounted to a rail or post mounted to the platform (see FIG. 9). In one case, a control switch may include a pivotally mounted lever. In one construction, the lever may be spring-biased so that the lever is movable in one direction for up, centered by a spring for neutral or working position, and moved in opposite direction for controlled downward movement of the lifting device. In one construction, a control switch being spring biased, after the operator releases the control switch, it returns to a neutral position(centered) and the motor resets to a ready to operate mode. Alternatively, the control switch may have multiple push buttons, such as one button for upward movement and another button for downward movement. Of course, other arrangements for the control of the vertical height adjustment are possible.

According to one arrangement, the lifting devices 100 and 200 have a limited vertical upward and downward travel distance to accommodate a majority of operational and workplace conditions. The distance of travel as measured from the platform to the floor surface may range from 1.0 inch to 36.0 inches, and may preferably ranges from 4.375 inches to 18.0 inches and in a preferred construction the travel distance may range from 6.375 inches to 17.75 inches. At the lowest most range of distance, the height off the floor surface can be adjusted by the thickness of the platform.

The range of travel can be limited by mechanical methods. For example, harden pins or set-screws 20, 215 may be placed in the threaded shafts 19, 203. In a preferred construction, mechanical stops facilitates triggering an automatic motor shutoff, if the operator persists in holding a return to neutral switch in the upward or downward position beyond the physical stopping range of the platform. This system operates by providing the motor with a thermal protection switch to automatically shut the motor off before overheating occurs at the limits of travel determined by the mechanical stops. Alternatively, limit switches may be operatively coupled to the motor at the limits of the maximum travel height and minimum height to stop the motor as well.

As can be appreciated, there may be a gap created between the platform bottom surface and the floor surface at the lower portion of the travel range. In an embodiment of the invention, a toe sensor or a foot sensor arrangement 310 may be mounted to the base support 1 in the formed gap. (see FIG. 1) The foot sensor may be a photoelectric sensor that detects an object; however, other type of sensors may be used, including contact sensors. The foot sensor may be operatively coupled to the electric motor 2 and controlled by a microprocessor controller unit 40. (see FIG. 8) In such as case, when a foot of a person becomes disposed under the platform bottom surface and the floor surface, the sensor detects the presence thereof. Accordingly, the motor shuts off to prevent the platform from pinching the foot of a user. In lieu of a foot sensor, a pivotable guard plate may be placed on the outer edge of the platform or an accordion or collapsible guard.

The lifting devices 100 and 200 include a user-friendly gate 314 that easily, and positively, locks after entrance and exit from the platform. (See FIG. 9) A double guardrail may be provided on the periphery of the platform. Advantageously, the operator is completely guarded from falling off the platform on all sides of the platform by the gate and double guardrails. Entrance onto the platform simply requires stepping up a step height of 1.0 to 7.5 inches from the floor onto the platform after opening the gate. Exiting the platform generally involves, the operator lowering the platform to a bottom position such as 1.0 inch above the floor surface and then opening the gate and stepping off the platform to the floor surface.

In a preferred construction, lifting devices 100 and 200 are mobile and portable, which allows for quick movement to and from different jobs or locations in a working location. The base support of the lifting devices 100 and 200 include caster wheels 8, 235, which are lockable at each job site for safety and unlock easily for moving to the next job site. The wheels 8 are mounted with a nut 9 (see FIG. 1) and wheels 235 are mounted with bolts 217 and nuts 236. The caster wheels enables the lifting devices 100 and 200 to be pushed, pulled and rotated on a floor surface as desired.

In a preferred use, a standing position in combination with a therapy platform places less compressive strain on the spinal vertebrae than a sitting position. The lifting devices can be used as a maintenance stand, such as in aircraft maintenance operations, assembly line operations, and other working conditions. The lifting devices are low maintenance requiring usually once a year lubricating.

In alternative constructions, lifting devices 100 and 200 may include a tiltable platform so that the operator has a further range of control for body positioning at a work surface. There may be a battery package supplied onto the lifting devices to power the electric motor. It is also possible to use the lifting devices as adjustable work tables by removing the platform and installing tiltable tabletop support brackets at the upper end of the movable channel members.

While the present invention has been described and shown with reference to preferred and exemplary embodiments, there arc any number of alternative combinations for defining the invention, which incorporate one or more elements from the specification, including the description, and drawings, in various combinations or sub combinations. It will be apparent to those skilled in the relevant technology, in light of the present specification, that alternate combinations of aspects of the invention, either alone or in combination with one or more elements or steps defined herein, may be utilized as modifications or alterations of the invention or as part of the invention.

I claim:

1. A lifting apparatus, comprising:

a base support for moving the lifting apparatus horizontally on a floor surface; the base support having a plurality of wheels being lockable;

a platform having a multilayer thickness for supporting at least a user thereon, the multilayer thickness having a non-slip outer layer, a compressible inner layer, a base layer; the platform is configured to be vertically moveable;

a vertical lifting system coupled to the platform and coupled to the base support; the vertical lifting system being configured to vertically move the platform through a plurality of heights above a floor surface; the vertical lifting system having a pair of laterally mounted hollow stanchions, each including an axially rotatable threaded rod for matingly receiving a gear which is mounted to a drive shaft which provides rotary movement to the gear; the vertical lifting system including a motor coupled to the drive shaft and configured to provide rotary movement to the drive shaft, the vertical lifting system including a controller unit operatively coupled to the motor configured to control the operation of the motor, and a non-contact foot sensing device mounted to the base support and operatively coupled to the controller unit, the sensing device configured to detect the presence a foot of a human body underneath the platform and prevent downward movement of the platform while the foot being detected.

2. The lifting apparatus of claim 1, wherein the wheels are casters.

3. The lifting apparatus of claim 1, wherein the motor is electric.

4. The lifting apparatus of claim 1, further including channel members and each of said the respective channel members.

5. The lifting apparatus of claim 4, in which the platform is laterally mounted to the channel members.

* * * * *

UNITED STATES PATENT AND TRADEMARK OFFICE

CERTIFICATE OF CORRECTION

PATENT NO. : 6,880,187 B1
DATED : April 19, 2005
INVENTOR(S) : Robert E. Johnson It is certified that error appears in the above-identified patent and that said Letters Patent is hereby corrected as shown below:

Column 6,
Line 61, replace "said the" with -- stanchions are mounted within the --.

Signed and Sealed this

Twenty-seventh Day of December, 2005

JON W. DUDAS
*Director of the United States Patent and Trademark Office*